United States Patent [19]

Lapointe

[11] 4,141,451

[45] Feb. 27, 1979

[54] CHIP THICKNESS CLASSIFIER

[75] Inventor: Joseph A. Lapointe, Montreal, Canada

[73] Assignee: Domtar Inc., Montreal, Canada

[21] Appl. No.: 866,838

[22] Filed: Jan. 4, 1978

[51] Int. Cl.[2] ..... B07C 5/04

[52] U.S. Cl. ..... 209/664; 209/667

[58] Field of Search ..... 209/97, 98, 99, 101, 209/106, 107

[56] References Cited

U.S. PATENT DOCUMENTS

| | | | |
|---|---|---|---|
| 196,456 | 10/1877 | Howard et al. | 209/99 |
| 1,173,737 | 2/1916 | Quesnell | 209/106 |
| 1,185,770 | 6/1916 | Cody | 209/99 |
| 1,472,279 | 10/1923 | Nordstrom | 209/98 |
| 2,895,610 | 7/1959 | Copping et al. | 209/98 |
| 2,984,351 | 5/1961 | Van Slyck et al. | 209/98 |

*Primary Examiner*—Joseph J. Rolla

*Attorney, Agent, or Firm*—C. A. Rowley

[57] ABSTRACT

A chip thickness classifier comprising a drum mounted for rotation about its longitudinal axis and having its periphery formed by a plurality of discrete longitudinally extending bars of elongated cross-section. The bars are arranged in substantially shingled relationship with one side of each bar spaced closer to the axis of rotation of the drum than the other side of the bar thereby to form outlet passages between adjacent bars. The outlet passages are substantially axially extending slots having their major width dimension measured substantially radially of the axis of rotation of the drum. Each of said bars is mounted for rotation about a longitudinally extending axis of the bar and the bars are interconnected by an adjustment mechanism that applies simultaneous incremental movement to stepwise rotate said bars and change said width dimension of the outlet passage. The drum is rotated in the direction wherein the side of each said bar closest the axis of rotation of the drum leads.

9 Claims, 6 Drawing Figures

CHIP THICKNESS CLASSIFIER

FIELD OF THE INVENTION

The present invention relates to a chip thickness classifier, more particularly the present invention relates to a device for classifying chips by thickness to a plurality of different thickness ranges.

BACKGROUND OF THE INVENTION

Generally chips are classified using a screen to give a chip analysis based on size rather than thickness. For example, TAPPI test RC16 superseded by useful method 21 (March 1974) specifies the use of an apparatus consisting of a plurality of screen plates mounted one on top of the other that are shaken for a period of time to classify the chips into the various size fractions.

A similar device has been designed for classifying chips in accordance with thickness, however, this device has not been generally accepted in the trade. It consists of a plurality of trays similar to that described hereinabove with respect to the TAPPI tests but with a plurality of parallel wires functioning as the screening elements. As in the TAPPI procedure, the trays are laid one upon another and shaken for a period of time to permit chips to be classified.

Other devices have been proposed for sorting or classifying chips in accordance with their thickness, however, to date, none have gained wide spread acceptance by industry because of their complicated nature, difficulty of operation and poor reliability. Thus there is no recognized standard chip thickness classification instrument or technique available.

It has been proposed to segregate mail by thickness using a rotary drum type apparatus as disclosed in Canadian Pat. No. 595,103 issued Mar. 8, 1962, Copping et al. In this device a plurality of plates are each mounted on a pair of brackets fixed one to each end of each plate and pivotedly mounted in a pair of annular end frame members to form the drum. The brackets are eccentrically weighted so that the plates pivot as the drum is rotated, thereby to increase the clearance between adjacent plates from a minimum clearance at the bottom to a maximum at the top of the rotation to free material trapped between adjacent plates so that it may fall back towards the centre of the drum. There is only a single setting whereby all the materials larger than a certain thickness will be retained and all the materials smaller than that thickness may pass between the adjacent plates.

It has also been proposed to grade beans utilizing a rotary drum type bean separator as disclosed in Canadian Pat. No. 788,300 issued June 25, 1968 to Grospety. The bean grader of this patent composed of a pair of end discs interconnected by fixed rods and expandable elements therebetween. The thickness or width of the expandable elements may be adjusted to vary the clearances between the expandable element and a pair of fixed transverse rods positioned one on each side of the expandable elements. The expansion is controlled by the position of a cam plate that can be moved axially relative to the drum to change the minimum expansion setting. The cam plate is provided with a camming surface that changes the expanded condition of the expandable members as the drum rotates, i.e. the expandable elements are at their maximum expansion for the particular cam setting during the bottom half of their rotation, and at a minimum thickness during the top half of their rotation the concept being that any materials wedged between the expandable members and the fixed rods will be released as the expandable members contract and will fall into the drum.

Neither the letter sorter of Canadian Pat. No. 594,103, nor the bean sorter Canadian Pat. No. 788,300 provide the means for separation capable of the classification of chips by thickness to provide a plurality of different thickness range fractions of the chips.

BRIEF DESCRIPTION OF THE INVENTION

The present invention provides a new concept for classifying chips in accordance with chip thickness.

Broadly the present invention comprises a drum mounted for rotation about its longitudinal axis, a plurality of discrete longitudinally extending bars of elongated cross-section arranged to extend substantially longitudinally of and to form the circumference of the drum with each of the bars being mounted to rotate about one of its longitudinal axes. The bars are positioned in substantially shingled relationship with one side of each bar radially spaced inwardly of the other side of its immediately adjacent bar thereby to form outlet passages between adjacent bars. The outlet passages are in the form of elongated slots extending substantially longitudinally of the drum and have their major width dimension measured substantially radially relative to the axis of the drum. An adjustment mechanism is connected to each of the bars whereby the adjustment mechanism applies simultaneous incremental rotational movement to all of the bars about their said longitudinal axis to rotate the bars and adjust step-wise the width of the passage between each pair of adjacent bars, and a latch mechanism locks the adjustment mechanism in various positions.

BRIEF DESCRIPTION OF THE DRAWINGS

Further features, objects and advantages will be evident from the following detailed description of the preferred embodiment of the present invention taken in conjunction with the accompanying drawings in which.

DESCRIPTION OF THE PREFERRED EMBODIMENTS

Figure 1:
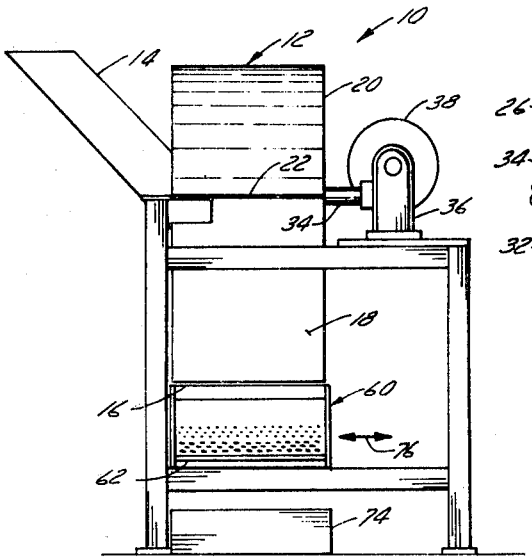
FIG. 1 is a side elevation of a chip thickness classifier incorporating the present invention.
Figure 3:
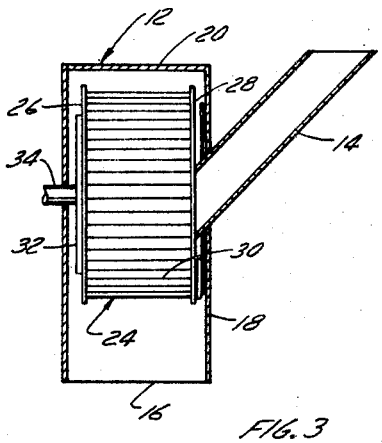
FIG. 3 is a partial section illustrating the arrangement of the chip thickness classifier of FIGS. 1 and 2.
Figure 2:
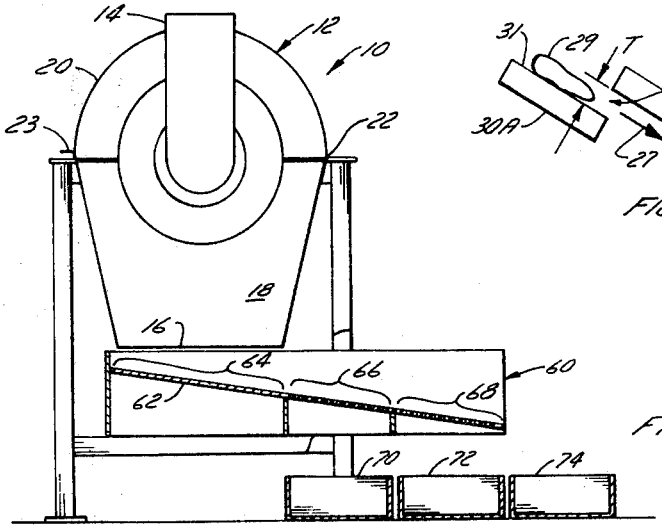
FIG. 2 is an end view of the chip thickness classifier of FIG. 1.

As shown in FIGS. 1, 2 and 3 the chip thickness classifier 10 of the present invention includes a housing 12 having an inlet spout 14 and a bottom outlet 16. The housing 12 is formed of a bottom section 18 having an upper section 20, pivoted thereto as indicated by the pivot 22 and liftable by the handle 23 to provide access to the classifying drum 24 contained within the housing.

The drum 24 is formed by a pair of annular end plates 26 and 28 each of which pivotably mounts opposite ends of screening bars 30, of elongated cross section which make up the circumference of the drum 24.

A mounting plate 32 is connected to the end plate 26 and closes one end of the drum 24. The inlet spout 14 communicates with the hole in the annular plate 28 to permit a chip sample to enter the drum.

Figure 4:
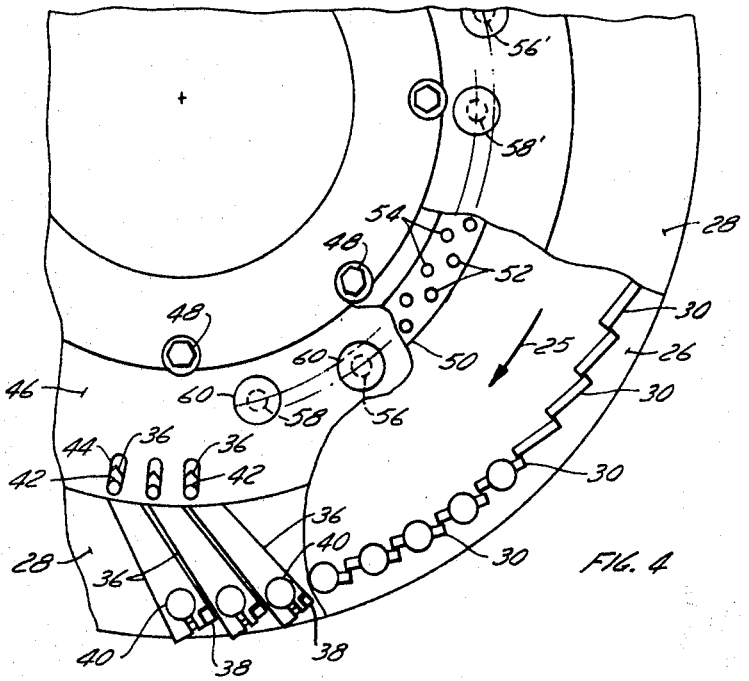
FIG. 4 is an enlarged cut-away view illustrating the adjustment mechanism for the screening rods.
Figure 6:
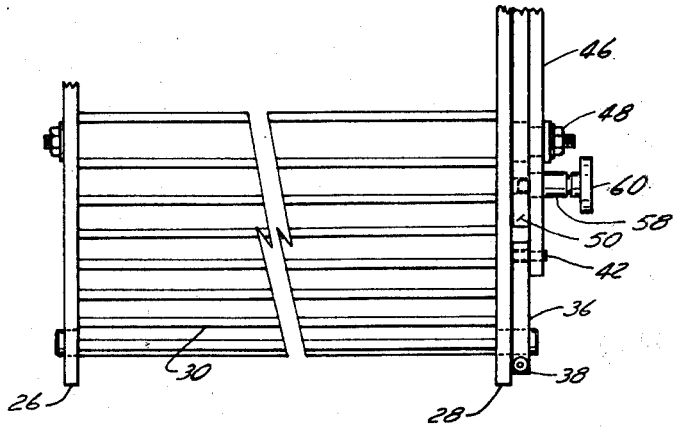
FIG. 6 is a view of the rotor illustrating the lateral position of the elements of the adjusting mechanism.

The drum 24 is mounted via a shaft 34 that projects from the center of the plate 32 and is connected through a gear reducer 36 with the drive motor 38 (FIG. 1) whereby the drum 24 is rotated in the direction of the arrow 25 (see FIG. 4). This direction of rotation is important to the operation of the separator as will be described hereinbelow.

Each of these screening bars 30 is a substantially flat bar having axially extending stub shafts at each end. These stub shafts, in the illustrated arrangement, have their longitudinal axis aligned with the longitudinal axis of the bar 30, however, this positioning is not critical, i.e. the stub could be shifted to either side of the bar. It is preferred that they be at the side edge of the bar closest to the axis of rotation of the drum so that the opening operation does not require lifting the chips. These stub shafts at the ends of the bars 30 are rotatably mounted in the plates 26 and 28 and arranged in a circle about the axis of rotation (shaft 34) of the drum 24 as shown in FIG. 4. It is preferred that adjacent side edges of adjacent said bars be positioned in shingled relationship i.e. there be a slight overlap of one side edge of one bar with the other side edge of an adjacent bar, however, this is not absolutely essential and the overlap may be omitted so that adjacent sides of adjacent bars may be spaced slightly in the circumferencial direction of the drum. Hence, the term "substantially shingled" is used in the disclosure to include a shingled relationship of adjacent bars or one wherein there is a slight circumferential spacing. It is important that the said one side of each bar be radially spaced relative to the other side of the adjacent bar so that the one edge is closer to the axis of rotation of the drum 24 than the said other side. By so mounting the adjacent bars 30 an outlet passage 33 (see FIG. 5) is formed between pairs of adjacent bars to permit chips to move along the inner surface 31 of one of the bars and to escape from the drum in a substantially circumferential (or tangential) direction. The maximum dimension of the passage 33 between a pair of adjacent bars 30 will be measured substantially radially of the drum i.e. in a substantially axial plane as indicated by dimention T, so that the chips sliding out on the surface 31 of a bar need not change direction significantly to exit from the drum. If there was a larger circumferential spacing between adjacent side edges of adjacent bars 30 than the narrowest setting for dimension T of the passages 33 some of the chips could leave the drum 24 in a substantially radial direction and the accuracy of the test would be lost.

In the illustrated arrangement wherein 60 bars are provided on a 24 inch diameter drum each bar is approximately $1\frac{1}{4}$ inch wide and the overlap between one side and the other side of an adjacent bar is approximately $\frac{1}{8}$ of an inch i.e. the overlap at each side of each bar is approximately $\frac{1}{8}$ of an inch.

The stub shaft for each of the screening bars 30 at one end of the drum 24 (in the illustrated arrangement at end of plate 28) project through the plate 28 (or 26) and each is provided with a rigidly connected arm 36 which in the illustrated arrangement is connected via a friction fit formed by tightening of the bolts 38 to clamp the stub shafts at the end of bars 30 in the slots 40. In a commercial model each arm 36 would probably be keyed in some way to the respective bar 30 so when an arm is replaced it would automatically be aligned with the other arms.

Figure 5:
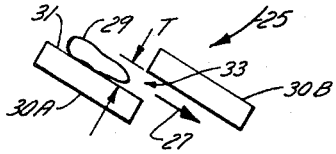
FIG. 5 is an isolated schematic cross section of a pair of adjacent securing bars illustrating the operation of the outlet passage between each pair of adjacent bars.

The opposite ends of the arms 36 are provided with pins 42 that are received within substantially radial slots 44 formed in a thickness setting ring 46 which is mounted for rotation relative to the end plates 26 and 28 on the bearings formed on the bolts 48 threaded into the end plate 28. The ring 46 is spaced from the end plate 28 via spacers on bolts 48 (not indicated) and an annular spacer 50 concentric with the opening in the plate 28. This spacing between the ring 46 and annular end plate 28 is sufficient accommodate the ends of the arms 36 as shown in FIG. 5.

The spacer 50 is provided with a pair of concentric rows of holes 52 and 54. The circumferential spacing between a pair of adjacent holes 52 and 54 in the rows determines the incremental adjustment of the bars 30. A pair of spring loaded plungers 56 and 58 extend through the adjustment ring 46 in a position to cooperate with the annular ring of holes 52 and 54 respectively. These spring loaded plungers 56 and 58 may be lifted from their respective holes 52 and 54 by lifting the hand grip portion 60 thereof (see FIGS. 4 and 5) moving the spring loaded pins. This arrangement significantly reduces the possibility of overshooting the adjustment since only one of the pins 56 or 58 is manipulated for any given adjustment and movement of the annular adjustment ring 46 can only proceed until the nonmanually retracted pin 56 or 58 overlies a hole 52 or 54 at which time that spring loaded pin will force itself into the hole and prevent rotation.

Only a single spring loaded pin 58 and 56 has been described, however, it is preferred to provide the two pins to cooperate with each of the rows of holes 52 or 54 (see pins 56' and 58') so that two pins must be withdrawn from one of the annular row of holes 52 or 54 e.g. the two pins 56 and 56' must be retracted from holes 52 to permit rotation of the ring 46. This use of two pins facilitates rotation since both hands contribute to the rotational forces. Furthermore since both hands are required to make the adjustment the possibility of overshooting (opening too much) is eliminated since the pins in holes 52 and 54 cannot be simultaneously manually retracted by an operator.

Positioned beneath the outlet 16 is a tray 60 which, as schematically illustrated, is provided with a sloped bottom 62 (see FIG. 2). Sloped bottom 62 is divided into three sections designated by the numerals 64, 66 and 68 respectively. The section 64 immediately below the outlet 16 is not perforated. Section 66 offset from the outlet is provided with a plurality of small holes which functions as a fines screen so that short fibre material leaving the drum 24 with the chips is separated as the sample passes over the screen section 66. Section 68 is provided with a plurality of holes of larger diameter and sized to pass any chips of an acceptable size. Positioned beneath the section 66 is a tray 70 to catch the short fibre fraction and positioned beneath the section 68 is a tray 72 which receives the desired sample. A tray 74 is provided at the end of the tray 60 to catch the oversized material having one dimension greater than the size of the hole in section 68 (generally splinters and the like). Preferably short imperforated sections will be provided between the sections 66 and 68 and between the section 68 and the end of the tray.

It is important that the section 66 not be positioned directly beneath the outlet 16 so that the chips fall onto the imperforate section 64 and orient themselves generally with their long dimension substantially parallel to the bottom 62. Providing this opportunity for the chips to so align improves the accuracy of the separation by length (the long chips that pass over the section 68 have less tendency to tip and fall through the holes).

The tray 60 is oscilated from side to side by a suitable mechanism schematically represented by arrow 76.

In operation the screen bars 30 are moved to their first setting, i.e. first opening from the position illustrated in FIG. 4. The sample of chips to be classified is inserted into the drum by the inlet chute 14 with the bars in the above described first position or closed position. Generally with the illustrated arrangement using a drum of about 21 inches in diameter in a housing about 12 inches in the axial dimension a random sample of about 1,500 to 2,000 grams is used. The sample size may change depending on the moisture content or sample composition. Motor 38 is then activated to drive via reducing gear 36 the shaft 34 and thereby the drum 24 to apply a tumbling action to the chips. As above indicated the direction of rotation designated by the arrow 25 is important it being essential that the inner side (side close to the axis of rotation of the drum) of each of the bars 30 lead in the direction of movement. This direction of movement permits these inner sides of the bars to function as lifting flights or lifters to help lift and tumble the chips as the drum rotates. Also this direction of rotation tends to move the bars relative to chips laying thereupon so that these chips tend to exit in a tangential direction by sliding out the outlet formed between a pair of adjacent bars i.e. in the direction of the arrow 27 shown in FIG. 5. Basically what happens is a chip as schematically illustrated at 29 in FIG. 5 lies in face to face relationship with the upper surface 31 of the leading bar indicated at 30A in FIG. 5 and tends to slide down the face 31 as the drum moves in the direction of the arrow 25 so that the chip passes through the substantially tangential outlet opening 33 formed between the leading bar 30A and the trailing 30B.

The chips of the pre-selected thickness designated by the size of outlet 33 (spacing T FIG. 5) slide out of the drum through the outlets 33 between the adjacent bars 30 onto the tray 60. The tray 60 is oscillated back and forth as indicated by the arrow 76, the direction of oscillation being at right angles to the direction of movement of the chips down the incline bottom 62 of the tray 60. This lateral movement of the tray 60 relative to the direction of sliding motion compared with tray movement in the direction of sliding motion slows the descent of the chips and improves the screening action in the tray 60.

As the chips traverse the perforated section 66 the short fibre fractions are separated therefrom and fall through the perforations in the section 66 into the tray 72. Those chips that pass over the section 66 reach the section 68 and assuming they are of the desired size they will pass through the apertures as in the section 68 and fall into the tray 72, i.e. the size of the holes or apertures in section 68 will be such that any chip with a maximum dimension less than a certain specified maximum dimension will fall therethrough. Those chips having one dimension longer than the preselected dimension (size of opening of the apertures in the section 68) normally slide off the end of the tray 60 into the receiving tray 74. The combination of the metering action of the drum, the direction of tray movement and the orientation of the chips by the imperforate section 64 ensures that substantially all of the overlength chips do not fall through the holes in section 68 but pass over tray 62 into receiving tray 74.

After a predetermined period of time the rotor 38 is stopped (when no more chips are leaving the drum 24) the tray 70 is removed and a new tray provided. The spacing between adjacent bars 30 is then adjusted by retracting the inserted pair of spring loaded pins say 58 and 58' and the ring 46 rotated relative to the plate 28 to increase the clearance T between the adjacent bars 30 until the pins 56, 56' are spring driven into the holes 52 in the spacer 50.

The above procedure of rotating the drum, oscillating the tray 60 and collecting the desired sample in the tray replacing tray 70 is then repeated. The whole operation is repeated as many times as required to obtain the chip thickness distribution of the initial sample.

The rotation of the ring 46 relative to the end plate 28 causes the sides of the slots 44 to engage the pins 42 and move the ends of the arms 36 in a direction which pivots each of the bars 30 about a longitudinal axis and thereby moves the side edges of these bars apart.

Access to the pins 56, 56' and 58, 58' is obtainable by providing a suitable opening in the housing. The manner of doing this, used on the prototype equipment was to pivotably mount the inlet chute 14 on the housing and use the inlet chute to define a portion of the front of the housing 18.

The latching mechanism which requires the retraction of a pin or pair of pins while leaving a second pin or pair of pins free ensures that when the second pin or pair of pins is moved by rotation of the adjustment ring into position over a suitably located aperture the pins automatically enter the aperture and there can be no accidental overshooting of the next adjustment. Without such a positive arrangement to permit overshooting there could be an accidental loss of sample if the bars 30 were opened too wide and then returned to their proper incremental setting.

Modification may be made without departing from the spirit of the invention as defined in the appended claims.

I claim:

1. A chip thickness classifier comprising a drum mounted for rotation about its longitudinal axis, a plurality of discrete longitudinally extending bars of elongated cross-section arranged to extend substantially longitudinally of and to form the circumference of said drum, each of said bars being mounted for rotation about a longitudinally extending axis of said bar, said bars being positioned in substantially shingled relationship with one side of each said bar radially spaced inwardly of the other side of its immediately adjacent bar thereby to form outlet passages between adjacent bars, said outlet passages being in the form of slots extending longitudinally of said drum and having their maximum width measured substantially radially relative to said axis of said drum, an adjustment mechanism, means interconnecting each of said bars with said adjustment mechanism for simultaneous incremental rotational movement of all of said bars about their said longitudinally extending axes by said adjustment mechanism thereby to stepwise rotate said bars and adjust said width of said outlet passages between each pair of adjacent said bars and latch means to lock said adjustment mechanism in an adjusted position.

2. A chip thickness classifier as defined in claim 1 wherein said means inter-connecting each of said bars with said adjustment mechanism comprises a plurality of discrete arms, one of said arms fixed to each of said bars and connected to said adjustment mechanism at a point spaced from said bars.

3. A chip thickness classifier as defined in claim 2 wherein said adjustment mechanism comprises an adjustment ring, and wherein said arms are connected to said adjustment ring by means of a pin and slot connection, said adjustment ring being mounted for rotation about the axis of rotation of said drum.

4. A chip thickness classifier as defined in claim 3 wherein said latch means comprises at least two retractable pins on said adjustment ring, a spacer plate mounted on said drum, holes in said spacer plate arranged in concentric circles, the holes in one of said circles being in a position to be engaged by said one of said pins and the holes in the other of said circles being in a position to be engaged by the other of said pins.

5. A chip thickness classifier as defined in claim 4 wherein four of said retractable pins are provided to engage in said holes.

6. A chip thickness classifier as defined in claim 1 further comprising a tray positioned beneath an outlet from said classifier, a sloping bottom in said tray, said sloping bottom extending beyond the outlet of said classifier, a fines screen formed in said sloping bottom beyond said outlet.

7. A chip thickness classifier as defined in claim 6 wherein a second screen is provided in said sloped bottom beyond said fines screen in the direction of travel of said chips down said sloped bottom, said second screen being formed with holes through which chips of the maximum acceptable size pass.

8. A chip thickness classifier as defined in claim 6 wherein said tray is reciprocated in a direction substantially perpendicular to the direction of movement of said chips as they slide down said sloping bottom.

9. A chip thickness classifier as defined in claim 8 wherein a second screen is provided in said sloped bottom beyond said fines screen in the direction of travel of said chips down said sloped bottom, said second screen being formed with holes through which chips of the maximum acceptable size pass.

* * * * *